United States Patent [19]

Camardella

[11] Patent Number: 4,725,017

[45] Date of Patent: Feb. 16, 1988

[54] BENCH COIL WINDER

[75] Inventor: Giuseppe Camardella, Saronno, Italy

[73] Assignee: Tekma Kinomat S.p.A., Caronno Pertusella, Italy

[21] Appl. No.: 795,237

[22] Filed: Nov. 5, 1985

[30] Foreign Application Priority Data

Nov. 9, 1984 [IT] Italy ..... 23527 A/84

[51] Int. Cl.[4] ..... H01F 41/06

[52] U.S. Cl. ..... 242/7.15; 242/7.09

[58] Field of Search ..... 242/7.09, 7.11, 7.14, 242/7.15, 7.17; 140/92.2; 29/745, 748, 755

[56] References Cited

U.S. PATENT DOCUMENTS

| | | | |
|---|---|---|---|
| 3,306,554 | 2/1967 | Henderson | 242/7.15 |
| 3,713,599 | 1/1973 | Smith et al. | 242/7.11 |
| 4,157,165 | 6/1979 | Bierman et al. | 242/7.09 |
| 4,173,312 | 11/1979 | Camardella | 242/7.11 |

*Primary Examiner*—Billy S. Taylor

*Attorney, Agent, or Firm*—Young & Thompson

[57] ABSTRACT

The invention concerns a bench coil winder, comprising a frame for the support of at least one rotary winding spindle, of a tailstock for the spindles, and of at least one movable wireguide for feeding and distributing the wire on the coil being wound. The frame is made in the form of a bedplate (1) and of at least one vertical wall (1A), on which are mounted all the elements forming the machine, and it comprises a body (2) covering all these elements, which is fixed on the bedplate (1). The wireguide (9) is mounted slidable according to the axis Y, perpendicularly to the front wall (2') of the covering body (2), onto a unit movable according to the axes X and Z; on this unit there is fixed a closing lamina (**2*b*), parallel and shortly spaced from the wall (2'), which closes a window (2*a*) provided in the covering body (2) to let through the wireguide (9). The center (41) for each spindle (33) is carried by a toggle-joint leverage (39, 40), which is mounted on a slide (43), movable parallely to the spindle axis under the control of a position adjustment device (45, 46**).

8 Claims, 5 Drawing Figures

BENCH COIL WINDER

BACKGROUND OF THE INVENTION

The present invention relates to a coil winder designed to produce wire coils for use in the electric and/or electronic field, and especially to a bench coil winder.

As known, there are a wide variety of coil winders, which comprise two main categories and precisely, on the one hand, the coil winders with revolving turret and, on the other hand, the coil winders in line. In the coil winders with revolving turret—of which an example is provided in West German Pat. Nos. 2,632,671 and 3,049,406 the coils are mounted on spindles radially projecting from a rotary indexing turret, so that the single coils are moved forward through successive working stations, for instance at least one loading station, a winding station and an unloading station, in addition to one or more supplementary or finishing working stations, so that when the coils are unloaded, they are substantially finished and ready to use.

In the coil winders in line, the coils are instead carried by a plurality of spindles with parallel axes, which are mounted on a support bed and have a simple high-speed rotary motion. With each spindle there cooperate corresponding wireguides, adapted to perform the main motion for wire distribution during coil winding, as well as a more complex motion—usually under numerical control—in order to twist the winding ends on the coil terminals, just before the winding starts and soon after it has finished. Besides the mentioned winding and twisting operations, these coil winders are sometimes adapted to perform only the loading, unloading and/or wire cutting operations. Any supplementary or finishing operations on the coils are not carried out on the coil winder in line, but generally on other machines positioned downstream thereof.

Coil winders of this type are widely known, for example from West German Pat. Nos. 2,632,671 and 3,049,406 and the Italian patent application No. 23327 A/84. These machines are designed for producing coils with fairly simple winding and with a large number of turns, at high production speeds.

The invention belongs to neither of the aforementioned main categories, but it concerns instead the so-called bench coil winders. These are small machines having one or several winding spindles, designed for the semiautomated small production of coils. The operator manually loads and unloads the coils on said spindles, and the machine only carries out the winding and, possibly, the twisting of the ends. No finishing operation is provided for.

Bench coil winders generally comprise a support frame in the form of a box-like body, obtained by casting, into which are formed, also by casting and subsequent machining, the seats for connection to the different mechanisms of the machine.

However, a structure of this type involves high costs and is, on the other hand, complicated and difficult to assemble as far as the various parts are concerned, the assembly thus requiring a particularly long time, with consequent difficulties also in the maintenance of the machine.

SUMMARY OF THE INVENTION

The object of the present invention is to realize a bench coil winder having an extremely simple and economical structure, of easy assembly and maintenance. This result is mainly obtained in that the support frame consists of a simple bedplate and of at least one vertical wall fixed to said bedplate, for supporting the elements forming the machine, and in that said vertical wall and said machine elements are enclosed in a covering body, which is in turn fixed on the bedplate.

As can be easily understood, this structure is extremely simple and economical, as the main element of the frame is the bedplate, which can be obtained, for example, starting from sheet-metal of slight thickness, for instance 5 to 6 mm thick. The vertical connection wall is preferably obtained by aluminium casting; however, as will also become evident from the following description, the problems and costs involved in this casting are positively limited in respect of those for casting the complete frames by the known technique. Furthermore, it is evidently very easy to assemble all the elements on said bedplate and on said wall, as the structure is open and it allows an easy access to all the parts. For the same reason, also maintenance is very easy, after mere removal of the covering body or enclosure.

BRIEF DESCRIPTION OF THE DRAWINGS

Further characteristics and advantages of the machine according to the invention will become more evident from the following detailed description of a preferred embodiment thereof, given by way of example with reference to the accompanying drawings, in which.

DESCRIPTION OF THE PREFERRED EMBODIMENTS

Figure 1:
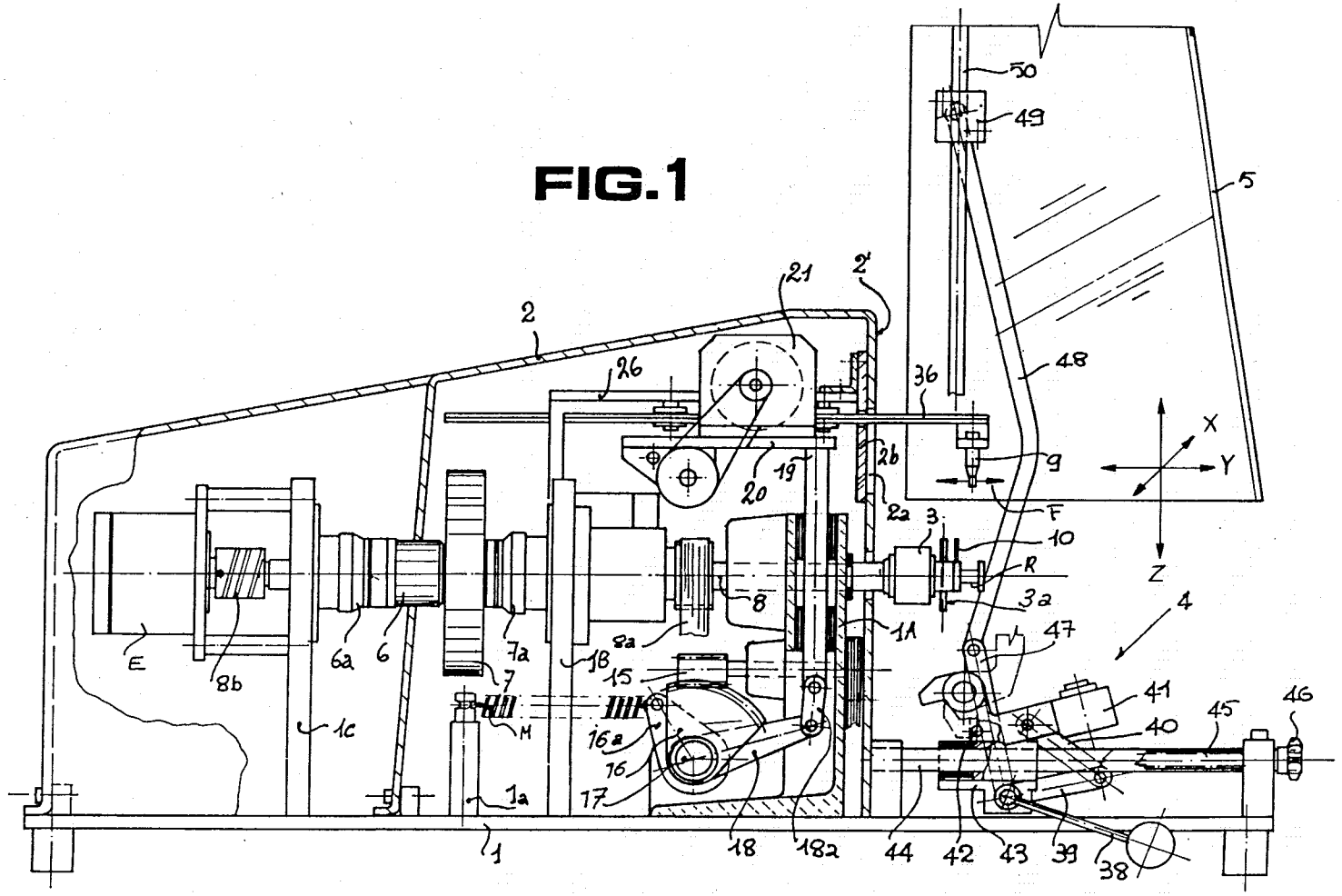
FIG. 1 is a side view, with parts removed, of the machine according to the invention.

As shown, the machine comprises a bedplate 1, preferably obtained starting from sheet-metal, and forming in practice the support frame for all the elements forming the machine, which will be better described hereinafter. These elements are enclosed in a covering body 2—of molded plastic material, particularly ABS—which is also fixed on the bedplate 1.

Outside the covering body 2 there remain only the spindles 3, supporting the reels R for the coils to be wound, the wireguides 9 with the respective support bar, and the tailstock 4,—better described hereinafter—above which a transparent protective cover 5 is applied during working.

A main vertical wall 1A, preferably obtained by aluminium casting, is fixed on the bedplate 1: on this wall there are mounted—as better described hereinafter—the winding spindles and all the machine elements controlling the movements of the corresponding wireguides. On the bedplate 1 there are moreover fixed the brackets 1B and 1C, carrying the means which cause the rotation of the spindles. Such means comprise first of all a horizontal shaft 8, controlled by an electric motor—preferably a direct current motor (not shown in the drawings, as it is normally positioned externally of the machine body)—by means of two pulleys 6, 7, coaxial to said shaft 8, and by means of two further pulleys, identical to the first ones, but keyed on the motor shaft in an opposite arrangement, so as to obtain two different gear ratios.

Figure 2:
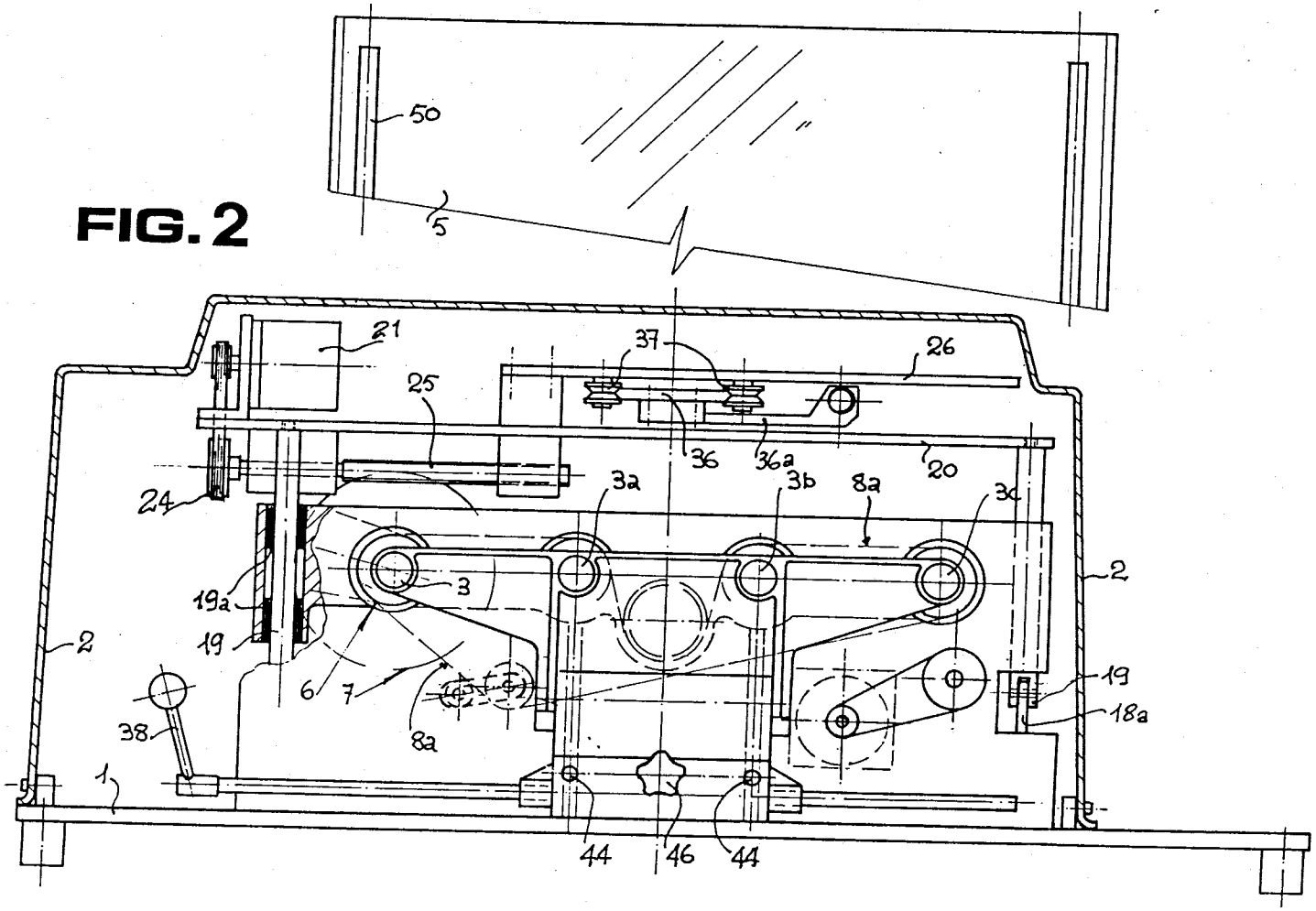
FIG. 2 is a front view, also with parts removed, of the same machine.

Two magnetic joints 6a and 7a alternately key the pulley 6, or the pulley 7, on the shaft 8 of the spindle 3, so as to impart thereon two different rotation speeds. From the main shaft 8, or spindle 3, the motion is transmitted to three further spindles 3a, 3b and 3c (see FIG. 2), by means of a toothed belt 8a.

An "encoder" device E—of a type known per se and normally used on machine tools, so that it is not described in detail herein—is connected to the shaft 8 through the joint 8b, so as to control directly the number of turns of said spindle 3.

A reel R, from which radially project the terminals 10, is mounted on the spindle 3, as well as on each of the spindles 3a, 3b and 3c (which latter will no longer be expressly referred to hereinafter, it being understood that any reference to the spindle 3 also concerns the other three spindles, which work in parallel).

With each spindle 3 there cooperates a wireguide 9—spaced from the reel R as shown in FIG. 1—which feeds wire to the rotating reel R, so as to carry out the winding. The "encoder" device E provides that the winding is formed according to a predetermined number of turns or turn fractions. Said wireguide 9 also performs to-and-fro movements, according to the arrows F of FIG. 1, so as to allow a uniform distribution of the wire turns on the reel, while this latter rotates. This motion is generally defined as "motion according to the axis Y", with reference to the conventional cartesian three coordinates.

Before starting each winding, the wireguide 9 carries first of all the starting end of the wire—already secured to a provisional anchor pin 3a fixed to the spindle 3—in correspondence with one of the terminals 10, around which it performs a twisting. The same twisting is performed, at the end of the coil winding operation, onto another terminal 10, and then again onto a provisional anchor pin 3a. It is indispensable to make this temporary anchorage just before cutting the wire between the pin 3a and the terminal 10, so as to prevent the wire end from escaping during unloading of the finished coils and loading of the empty reels.

To carry out these twisting operations, the wireguide 9 performs—in addition to the already cited movement according to the axis Y—also a movement according to the two axes X and Z of said cartesian coordinates: first of all a downward movement, according to the axis Z, to draw close to the terminal 10, and then a rotary motion in a horizontal plane, about terminal 10 as a center obtained through a combination of movements according to the axes X and Y.

Figure 4:
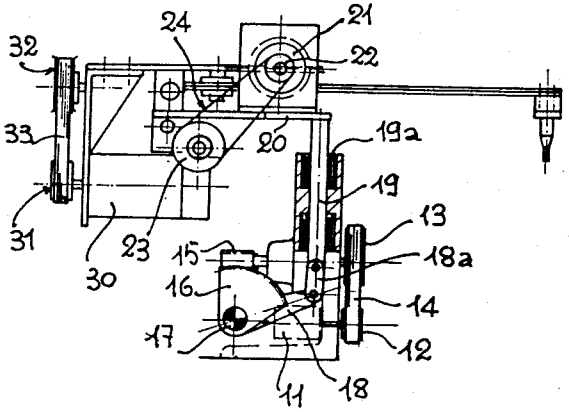
FIGS. 3, 4 and 5, are respectively, a front view, a side view and a plan view, of the unit controlling the movements of the wireguide.

According to a characteristic aspect of the present invention, a platform 20 movable in the vertical sense (axis Z) is used first of all to carry out the above movements. For this purpose, the platform 20 is fixed to the top of two rods 19, mounted vertically slidable inside two pairs of bushings 19a (only one being shown at the left of FIG. 2 and in FIG. 4, for simplicity).

The movements of the platform 20 according to the axis Z are controlled by a motor 11 (FIGS. 1 and 4) which, through the pulleys 12 and 13 and the toothed belt 14, causes the rotation of the worm screw 15 which engages with the sector gear 16. This latter is keyed onto a shaft 17, which is positioned parallel to the machine front and to the wall 1A. Two arms 18 are welded to the opposed ends of the shaft 17, which has sufficient torsional rigidity to guarantee a perfect parallelism of motion to the two arms 18. The motion transmitted by the sector gear 16 to the shaft 17 and by this latter to the arms 18, is imparted—by means of the links 18a—to the lower ends of the rods 19, which are guided so as to perform a vertical motion according to the axis Z. Said vertical motion is then transmitted to the platform 20 supporting the unit of the wireguides 9. The platform 20 is preferably welded to the upper end of the rods 19, so as to form therewith a substantially rigid unit. A traction spring M, connected at one end to the lever 16a fixed to the sector gear 16 and, at the other end, to a column 1a fixed to the bedplate 1, acts to balance the weight of the platform 20 and of the elements supported by said platform, so that all this weight does not have to be supported by the screw 15.

On the platform 20 there is mounted a plate 26, which is slidable horizontally, according to the axis X, like a carriage. The plate 26 is guided horizontally on three points and precisely, on one side, by means of bushings 26a and 26b sliding on the shaft 28 fixed to the platform 20 and, on the other side, by simple bearing of the spacer 20 on said platform 20.

Figure 5:
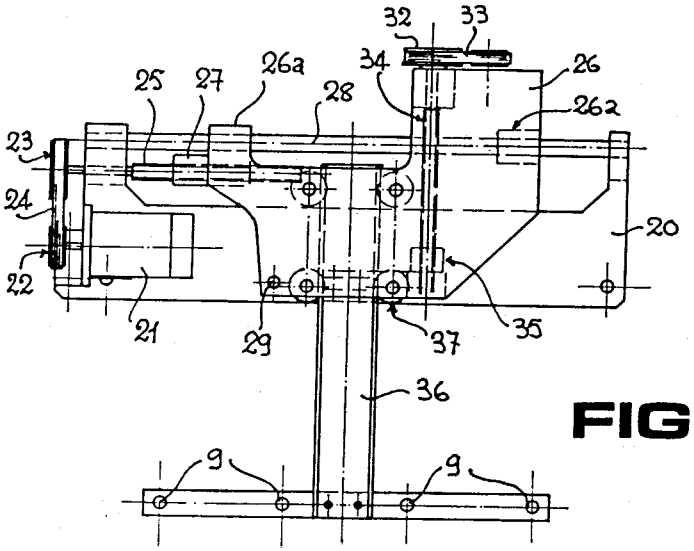

A motor 21 controls the movements according to the axis X. The motor 21 is fixed on the platform 20 and, through pulleys 22 and 23 and the toothed belt 24, it transmits rotation to the screw 25 (FIG. 5). With the screw 25 there cooperates the screw nut 27, particularly a ball screw nut, fixed directly to the plate 26.

Figure 3:
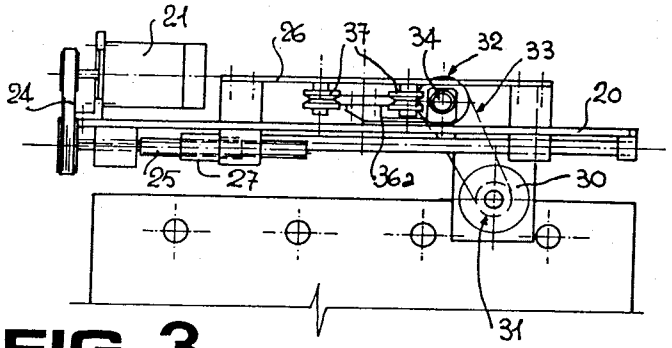

Finally, on the plate 26 there is also mounted a prismatic bar 36, slidable horizontally according to the axis Y. The bar 36 is guided by pairs of race rollers 37, as is clearly shown in FIGS. 2, 3 and 5. A motor 30 (FIGS. 3 and 4) controls the movements of the bar 36 according to the axis Y. The motor 30, through pulleys 31 and 32 and through the toothed belt 33, operates the screw 34 (FIG. 5), engaging with the ball screw nut 35. This latter is connected to the bar 36 by way of the arm 36a (FIG. 2), to which it transmits the movements imparted by the screw 34.

The motors 11, 21 and 30 can be known stepping motors, or closed loop direct current motors, under electronic control, in a manner known per se.

As already mentioned, by combining the movements according to the axes X and Y, it is possible to impart to the wireguide 9 a rotary motion in a horizontal plane, to produce the twisting of the wire end on the terminals 10 and/or on the pins 3a.

As shown in FIG. 1, the prismatic bar 36 projects from the front surface 2' of the covering body 2 through a window 2a, the dimensions of which correspond to the maximum strokes of the wireguide 9, according to the axes X and Z respectively. This window, such as is provided in the known machines of this type, has however the inconvenience of letting dust and dirt penetrate into the covering body 2, in spite of the presence of shields, for instance of rubber or like.

According to an interesting characteristic of the present invention, the above drawback is overcome by fixing to the plate 26 a closing lamina 2b, positioned on the inner side of the front wall 2' of the covering body 2, parallel thereto and spaced therefrom by only a few millimeter tenths.

The lamina 2b, moving together with the plate 26, merely performs movements according to the axes X and Z, so that it always remains at a short distance from the front wall of the covering body 2, thereby closing the window 2a. Of course, in order to perform this closing function, the size of the lamina 2b—taking into account, on the one hand, the breadth of the window 2a and, on the other hand, the maximum strokes, according to the axes X and Y, performed by the bar 36 inside said window—must be sufficient to guarantee, in any position, the closing of the window 2a.

The tailstock 4 comprises a control lever 38 which, by way of the toggle-joint leverage 39 and 40, causes the upward oscillation of the center 41 up into alignment with the toggle, so as to carry the center 41 against the stop pin 42: in this position, the center 41 bears against the outer end of the reel R and holds it during rotation, in a manner well known per se. At the end of the winding, by means of the same control lever 38 and toggle 39, 40, the center 41 is caused to oscillate downward, so as to be moved away from the reel R and allow easy unloading and loading.

According to a further interesting characteristic of the present invention, the tailstock 4—comprising the control lever 38 and toggle 39, 40—is mounted on the slide 43, which is guided on two pins 44 and the position of which is adjusted by means of the screw 45. A knob 46 allows controlling the rotation of the screw 45, to perform said adjustment.

The same control lever 38 also operates the arm 47 and thus the rod 48, which serves to lift the transparent cover 5. For this purpose, the cover 5 is mounted vertically slidable on four ball bushings 49, along two rods 40 fixed to the bedplate 1.

As clearly evidenced by the above description and accompanying drawings, the machine according to the present invention is of extremely simple construction and assembly, thanks particularly to the support frame being in the form of a bedplate, on which the single parts can be easily mounted. For this same reason, also the maintenance and repair operations are extremely simple and quick, after mere removal of the covering body 2. The simplicity of the frame and the molded plastic structure of the covering body 2 make the machine also very light and easy to transport. The tailstock structure, with the control and support leverage mounted on a slide adjustable in position, makes it very easy to adjust the position of the center; furthermore, said adjustment is not affected by the repeated operations of opening and closing the tailstock. Even the connection of the control for opening the front cover to the control for opening the tailstock constitutes an evident advantage for the operator, and is moreover obtained in an efficiently simple way. Finally, the arrangement of the lamina closing the window for the passage of the wireguide bar, adapted to move with the unit supporting said wireguide, forms an efficient, small-sized and very simple barrier to the inlet of dirt into the machine.

It is to be understood that the invention is not limited to the particular embodiment described, and that many modifications can be introduced therein, all within reach of a technician skilled in the art and all falling within the scope of protection of the invention itself.

I claim:

1. In a bench coil winder comprising a frame, a spindle, means mounting the spindle for rotation on the frame, the spindle being adapted to support a winding coil, a wireguide mounted on the frame for feeding and distributing wire onto the coil being wound on the spindle, and means supporting the wireguide on the frame for movement along three orthogonal axes; the improvement in which the frame comprises a bedplate, at least one vertical wall fixed to the bedplate for rotatably supporting the spindle, a cover mounted on said frame, said cover enclosing said vertical wall and being fixed to the bedplate, and seats on said vertical wall defining guides for vertically guiding the movement of said support means of the wireguide.

2. A coil winder as claimed in claim 1, and means for rotating the spindle, and brackets supporting said mounting means of the spindle, said brackets being fixed on said bedplate.

3. A coil winder as claimed in claim 1, in which said bedplate is of sheet metal.

4. A coil winder as claimed in claim 23, in which said sheet metal is 5 to 6 mm thick.

5. A coil winder as claimed in claim 1, in which said vertical wall is an aluminum casting.

6. A coil winder as claimed in claim 1, said vertical wall having seats in which bearings are mounted for rotatably supporting said spindle.

7. In a bench coil winder comprising a frame, a spindle, means mounting the spindle for rotation on the frame, the spindle being adapted to support a winding coil, a wireguide mounted on the frame for feeding and distributing wire onto the coil being wound on the spindle, and means supporting the wireguide on the frame for movement along three orthogonal axes; the improvement in which the frame comprises a bedplate, at least one vertical wall fixed to the bedplate for rotatably supporting the spindle, and a cover mounted on said frame, said cover enclosing said vertical wall and being fixed to the bedplate, said means supporting the wireguide comprising a support bar, said support bar projecting through a window formed in a front wall of said cover, said bar being movable lengthwise of itself, a carriage plate carrying said bar and mounted for movement in all directions perpendicular to said bar, and a closing lamina disposed in a plane perpendicular to said bar and closing said window.

8. A coil winder as claimed in claim 7, said closing lamina being disposed on the inner side of said front wall parallel to said front wall and spaced a short distance therefrom, the dimensions of said lamina being sufficient to close said window in any position of said bar.

* * * * *